US006025811A

United States Patent [19]

Canora et al.

[11] Patent Number: 6,025,811

[45] Date of Patent: Feb. 15, 2000

[54] CLOSELY COUPLED DIRECTIONAL ANTENNA

[75] Inventors: Frank J. Canora, Millbrook; Duixian Liu, Ossining; Modest Michael Oprysko, Mahopac, all of N.Y.

[73] Assignee: International Business Machines Corporation, Armonk, N.Y.

[21] Appl. No.: 08/844,872

[22] Filed: Apr. 21, 1997

[51] Int. Cl.[7] ..... H01Q 9/28; H01Q 19/185

[52] U.S. Cl. ..... 343/793; 343/795; 343/822; 343/824

[58] Field of Search ..... 343/818, 819, 343/846, 810, 812, 815, 817, 792, 793, 833–836, 700 MS; H01Q 19/10

[56] References Cited

U.S. PATENT DOCUMENTS 4,290,071 9/1981 Fenwick ..... 343/819
4,812,855 3/1989 Coe et al. ..... 343/818
5,061,944 10/1991 Powers et al. ..... 343/795
5,489,914 2/1996 Breed ..... 343/818

*Primary Examiner*—Robert H. Kim
*Attorney, Agent, or Firm*—F. Chau & Associates, LLP

[57] ABSTRACT

Disclosed is a dipole array antenna that is particularly useful at UHF and microwave frequencies. In an exemplary embodiment, the antenna is comprised of two dipole radiating elements—a driven dipole of length L1 and an unfed element closely spaced from the driven element, of length L2. The ratio L1/L2 is at least 1.1, and may be optimally set at about 1.3. Preferably, at a reference frequency in which VSWR is minimum, the length L2 of the unfed element is less than 0.45 wavelengths, and optimally, is in the range of 0.39–0.42 wavelengths, with dipole spacing in the range of 0.07 to 0.11 wavelengths at the reference frequency. Advantageously, the antenna exhibits a low VSWR in a 50 ohm system over an operating frequency band, whereby a matching network can be avoided. High gain and front-to-back ratio is also realizable while antenna size is kept small.

20 Claims, 7 Drawing Sheets

CLOSELY COUPLED DIRECTIONAL ANTENNA

FIELD OF THE INVENTION

This invention relates generally to radio frequency (RF) antennas. More specifically, this invention relates to a directional dipole array antenna employing closely coupled radiating elements.

BACKGROUND

Dipole array antennas, such as the log periodic and Yagi (or Yagi-Uda) antennas, are widely used. An attribute of the Yagi antenna is its high gain, whereas the log periodic antenna is known for its wide bandwidth. Both of these antenna types consist of at least three different length dipoles in most cases, and are primarily used for frequencies below one GHz.

The Yagi antenna typically consists of three antenna elements: a driven element of length L1 connected to an RF source and/or receiver, a director of length L2 and a reflecting element of length L3. Typically, the director length L2 is shorter than the driven element length L1 by 5%, whereas the reflector element length L3 is 5% longer than L1. The director is closely spaced in parallel to the driven element in order for radiation currents to be induced on the director's surface by near field coupling. This technique avoids the necessity of feeding multiple radiating elements individually. Higher antenna gain can be achieved by adding additional directors.

One drawback of both the log periodic and Yagi antennas is that they are not well matched to standard 50 ohm transmission lines. As a result, matching networks are required to match the antenna impedance to the 50 ohm feed line. These matching networks add to the antenna complexity and cost.

In addition, conventional log periodic and Yagi antennas are not well suited for use at higher microwave frequencies, e.g., 2.4 and 5.8 GHz Industrial, Scientific and Medical (ISM) bands. As RF communication has become more prolific at microwave frequencies, there has arisen a need for small, low cost antennas with high performance. Accordingly, the present invention addresses this need.

SUMMARY OF THE INVENTION

The present invention is directed to a dipole array antenna that is particularly useful at UHF and microwave frequencies. In an exemplary embodiment, the antenna is comprised of two dipole radiating elements—a driven dipole of length L1 and an unfed dipole of length L2, closely spaced from the driven dipole and excited by near field coupling. The length ratio L1 /L2 is at least 1.1. Preferably, at a reference frequency in which voltage standing wave ratio (VSWR) is minimum, the length L2 of the unfed element is less than 0.45 wavelengths. Advantageously, with proper selection of the antenna parameters, the antenna exhibits a low VSWR in a 50 ohm system over an operating frequency band, whereby a matching network can be avoided.

In one preferred embodiment, the length ratio L1/L2 is about 1.3, the unfed element has a length in the range of 0.39–0.42 wavelengths, and the spacing between driven and unfed dipoles is in the range of 0.07 to 0.11 wavelengths at the reference frequency. This combination is found to provide a low VSWR (less than 2:1 in a 50 ohm system) over approximately a 20% bandwidth. In addition, high gain and a large front-to-back ratio is realizable.

The antenna preferably includes only the driven dipole and the unfed dipole (i.e., an additional reflective element is avoided). As such, the antenna size is kept small to permit use in a variety of applications such as in personal communicators.

The antenna can be manufactured as either a wire antenna or a printed circuit antenna on a single or double sided printed circuit board.

BRIEF DESCRIPTION OF THE DRAWINGS

Preferred embodiments of the present invention are described herein with reference to the drawings, in which like reference numerals identify similar or identical components throughout the several figures, wherein.

DETAILED DESCRIPTION OF THE PREFERRED EMBODIMENTS

Figure 1:
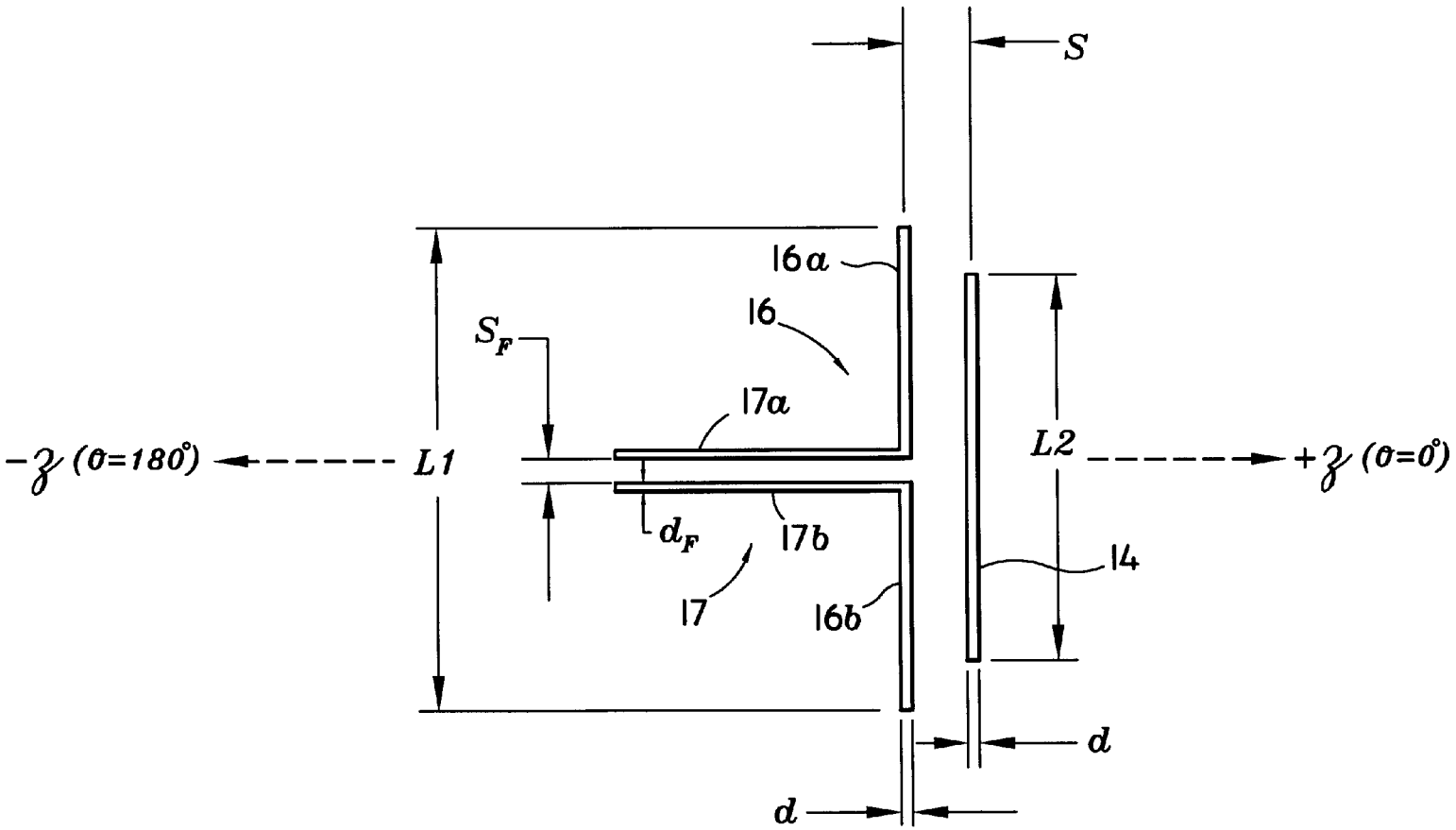
FIG. 1 is a view of an antenna in accordance with the present invention.

Referring to FIG. 1, there is shown a plan view of an antenna 10, which is a first embodiment of the present invention. Antenna 10 has two radiating dipole elements—a driven element 16 of length L1, and an unfed element 14 of length L2. Elements 14 and 16 are both wires or rods of diameter d in this embodiment. Dipole element 16 has two sections, 16*a* and 16*b*, with radiating currents sinusoidally flowing on the two halves as in a conventional dipole. Dipole element 14 is composed of a continuous metal wire. A spacing S between the dipoles is sufficiently small to allow dipole currents to flow on the unfed element 14 due to the near-field coupling from the fields of dipole 16. For example, S may be in the range of 0.07 to 0.11 wavelengths. The antenna beam thus produced by the radiation currents on the two dipoles has a maximum in the direction +z corresponding to an angle $\theta=0°$. Computed antenna patterns will be presented below referenced to the space angle $\theta$.

A twin-line feed 17 of preferably 50 ohms characteristic impedance can be connected directly to dipole 16 by connecting section 16*a* to wire 17*a* and section 16*b* to wire 17*b* of twin-line feed 17. A matching network is unnecessary since the input impedance of antenna 10 is set close to 50 ohms by appropriate selection of the dipole element lengths, the spacing between the dipoles, and the dipole diameters as will be described below. The twin-line feed impedance is a function of the wire diameters $d_F$, the wire spacing $S_F$ and the dielectric between the wires, as is known to those skilled in the art. Twin-line feed 17 may connect directly to coplanar stripline of 50 ohms, or directly to electronics behind antenna 10 (in the −z direction).

In the alternative, a balun can be used to interface dipole 16 with an unbalanced transmission line such as a coaxial or microstrip line which provides transmit RF power or delivers received power to or from the driven element 16. Many different baluns can be used, as known to those skilled in the art. The particular balun choice is not critical to the present invention. However, the balun should be selected to avoid a matching network to match the transmission line impedance, e.g., 50 ohms, to the antenna/balun input impedance.

Antenna 10 is similar in structure to a Yagi antenna. However, as discussed above, the electrical length of the director (unfed dipole) in a Yagi antenna is about λ/2 at band center. Moreover, the length ratio L1/L2 of the typical Yagi antenna is between about 1.0 to 1.05 and the element spacing S is typically λ/4. In contrast, with the present antenna 10, the length ratio L1/L2 is in the range of 1.1 to 1.5 (or higher). In addition, L2 is preferably less than 0.45 λc, where λc is the wavelength in which minimum VSWR occurs (which may or may not occur at the center of the operating band, depending on the operating bandwidth). Most preferably, the length ratio L1/L2 is about 1.3, L2 is in the range of 0.39–0.42 λc, and the element spacing S is in the range of 0.07–0.11 λc. (The exact length L2 and element spacing S is selected in dependence upon the diameter d of each dipole). Further, antenna 10 is designed to be substantially matched to a 50 ohm system over a desired operating band, e.g., up to about 20%.

By optimizing the lengths of dipoles 14 and 16, superior results are achieved as compared to conventional Yagi antennas. Although the length ratio L1/L2 of antenna 10 can be anywhere from 1.1 to 1.5 or higher, a smaller length ratio (closer to 1.1) results in a narrower bandwidth. A larger length ratio improves the antenna bandwidth and front-to-back ratio (FBR), the latter being defined as the ratio of radiated power in the +z direction relative to that in the −z direction. With a larger front-to-back ratio, the radiation at the rear of the antenna (−z direction) is lessened, thereby reducing the effect of radiation on electronic parts of the device located thereat. A drawback of a larger length ratio is that the overall antenna size is increased. Accordingly, the antenna can be optimized for size and bandwidth/FBR. For example, with L1/L2=1.3 and L2 in the range of 0.39–0.42 λc as mentioned above, a VSWR of lower than 2:1 in a 50 ohm system is attainable (ideally) over a frequency band of about 0.85 $f_C$ to 1.05 $f_C$, where $f_C$ is defined as the frequency in which VSWR in a 50 ohm system is a minimum. In addition, front-to-back ratio is more than 10 dB and gain greater than 3 dBd (dB relative to half wavelength dipole) over a six percent bandwidth. As a result, a small size antenna is realizable with low VSWR without the need for costly and complex matching structures. The antenna can thus be manufactured with high efficiency at a low cost.

Antenna 10 includes only the two dipoles 14 and 16, avoiding the use of an additional reflector element as is common with most Yagi antennas. By excluding an additional reflector element, antenna size is kept small. A small antenna size is advantageous, and often essential, for many applications such as in personal communicators.

Figure 2A:
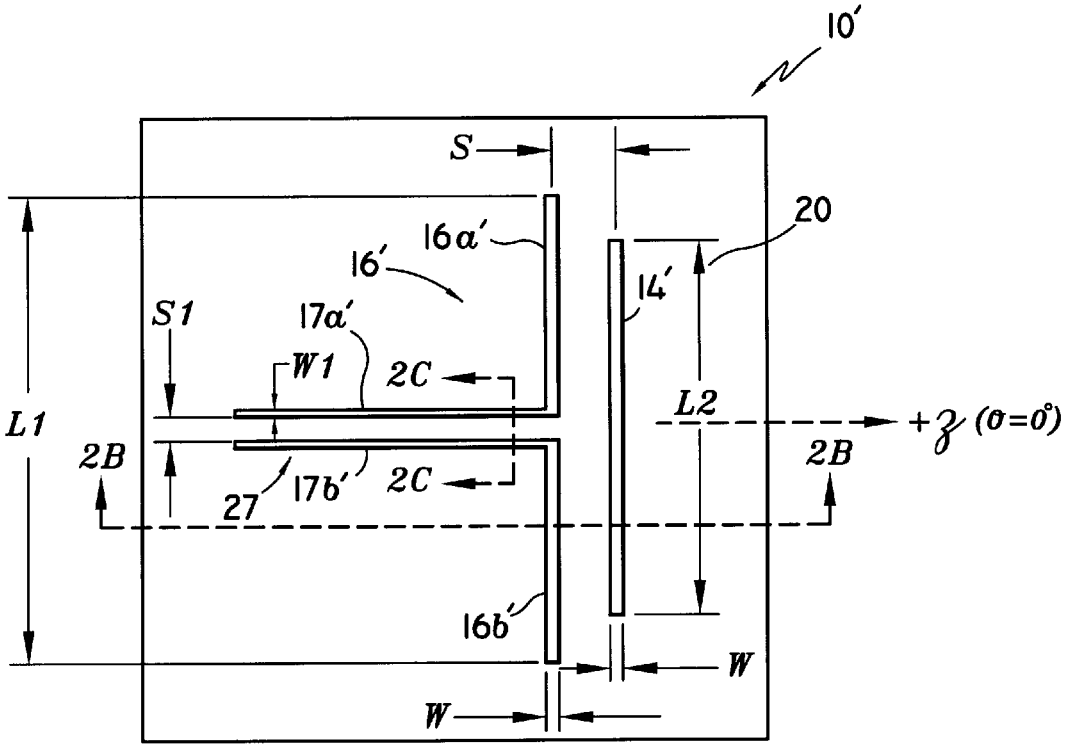
FIG. 2A is a plan view of an antenna of this invention fabricated on a single sided printed circuit board.
Figure 2B:
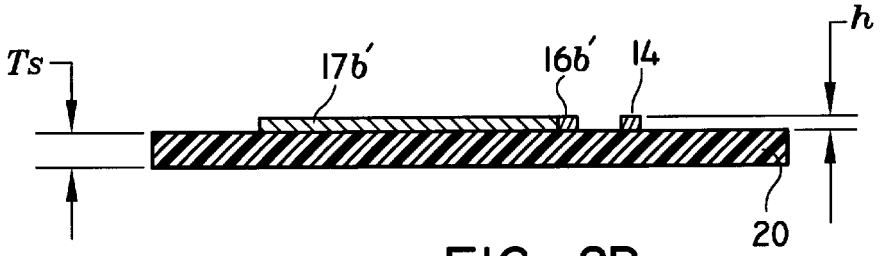
FIG. 2B is a cross-sectional view of the antenna of FIG. 2A taken along the lines 2B—2B.
Figure 2C:
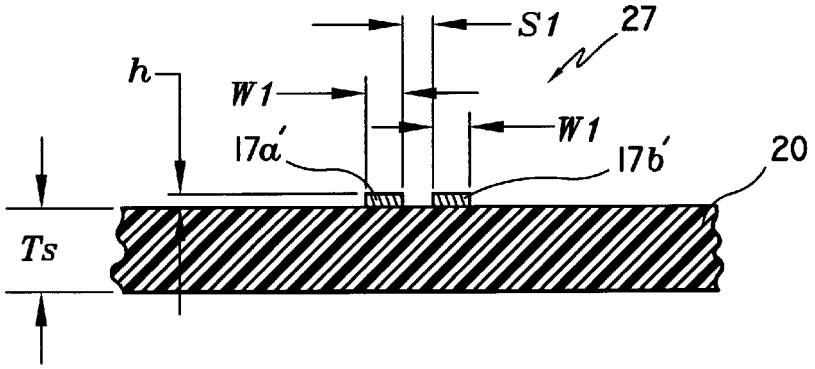
FIG 2C is a cross-sectional view of the feed portion of the antenna of FIG. 2A taken along the lines 2C—2C.

With reference now to FIGS. 2A–2C, there is shown a printed circuit board (PCB) embodiment of the present invention, designated as 10'. In this embodiment, a driven dipole 16' and unfed dipole 14' are each formed as printed metallization of width W and thickness h on a dielectric substrate 20. The dipoles are formed by selective patterning and etching on a single sided printed circuit board, i.e, with metallization on only one side. Feed lines 17*a*' and 17*b*' connect perpendicularly to dipole sections 16*a*' and 16*b*', respectively, of the driven dipole 16'. Feed lines 17*a*', 17*b*' together define a coplanar stripline 27, shown more clearly in FIG. 2C, preferably of 50 ohm characteristic impedance. As known to those skilled in the art, the characteristic impedance of coplanar stripline is a function of the width W1, the height h of each conducting strip, the spacing S1 between the strips, and the height $T_s$ and dielectric constant of the substrate 20. Coplanar stripline 27 connects to electronics (not shown) behind antenna 10, for example, to a duplexer or transmit/receive module of a small communication device or wireless computing device. The selection of the dipole lengths L1 and L2 and spacing S is analogous to that discussed above for the wire antenna 10, except that the dielectric constant and thickness $T_s$ of substrate 20, and the width W and height h of the dipole metallization are factors that influence the radiation pattern and impedance. These parameters are selected to provide an antenna impedance that substantially matches the impedance of coplanar stripline 27, preferably 50 ohms. In the wire antenna 10 of FIG. 1, the dipole diameter influences the radiation pattern and impedance, as will be discussed further below.

Figure 3A:
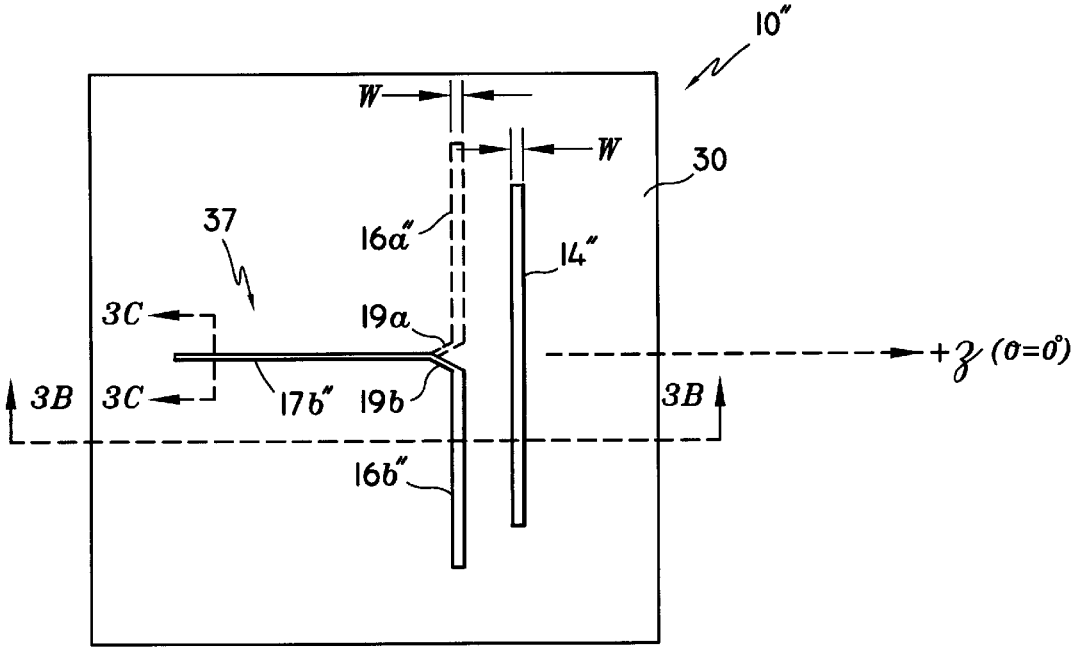
FIGS. 3A and 3B a plan and sectional views, respectively, of an embodiment of this invention fabric on a double-sided printed circuit board.
Figure 3B:
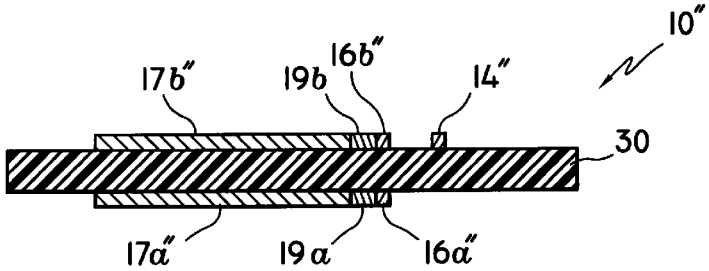
Figure 3C:
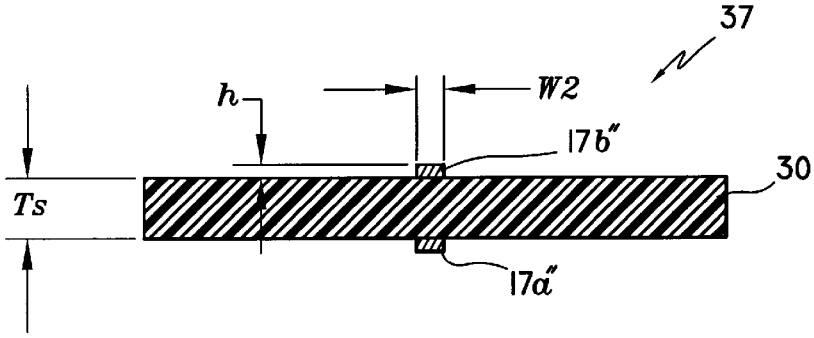
FIG. 3C is a cross-sectional view of the feed portion of the antenna of FIG. 3A taken along the line 3C—3C.

Referring now to FIGS. 3A–3C, another printed circuit embodiment of an antenna in accordance with the present invention is shown, designated as 10". In this embodiment, antenna 10" is formed on a double sided printed circuit board with dielectric layer 30 separating metallization layers on both sides. The metallization on both sides is selectively patterned and etched to produce the dipoles. Formed on the top side of substrate 30 is unfed dipole 14", driven dipole section 16*b*", feed line 17*b*", and a tapered feed line portion 19*b* connecting elements 16*b*" and 17*b*". On the opposite side, driven dipole section 16*a*" is formed along with feed line 17*a*" and tapered section 19*a* connecting elements 17*a*" with 16*a*". Hence, dipole section 16*a*" is offset from dipole section 16*b*" by the thickness Tc of substrate 3*a*. As such, thickness Tc should be sufficiently small so that the offset does not adversely affect the radiation pattern. Feed lines 17*a*" and 17*b*" together define a broadside coupled stripline 37 of preferably 50 ohms characteristic impedance. As shown in FIG. 3C, the stripline 37 impedance is a function of the width W2 and height h of each conducting strip, and the thickness Tc and dielectric constant of substrate 30 separating conductive strips 17*a*", 17*b*". In an alternative embodiment, radiating sections 16*a*" and 16*b*" could be formed on the same side of substrate 30, with feed lines 17*a*" and 17*b*" on opposite sides. In this case, a feed-through would be utilized that feeds through the substrate 30 to connect feed line 17*a*" with radiating section 16*a*". In either embodiment, the double sided design provides substantially the same performance as the single sided PCB or wire designs. The dipole lengths L1 and L2 and spacing S are selected in essentially the same manner as discussed above, i.e., with L1/L2 typically in the range of 1.1 to 1.5, L2 typically less than 0.45 λc, and so forth, to achieve low VSWR and avoid the necessity of a matching network.

Figure 4:
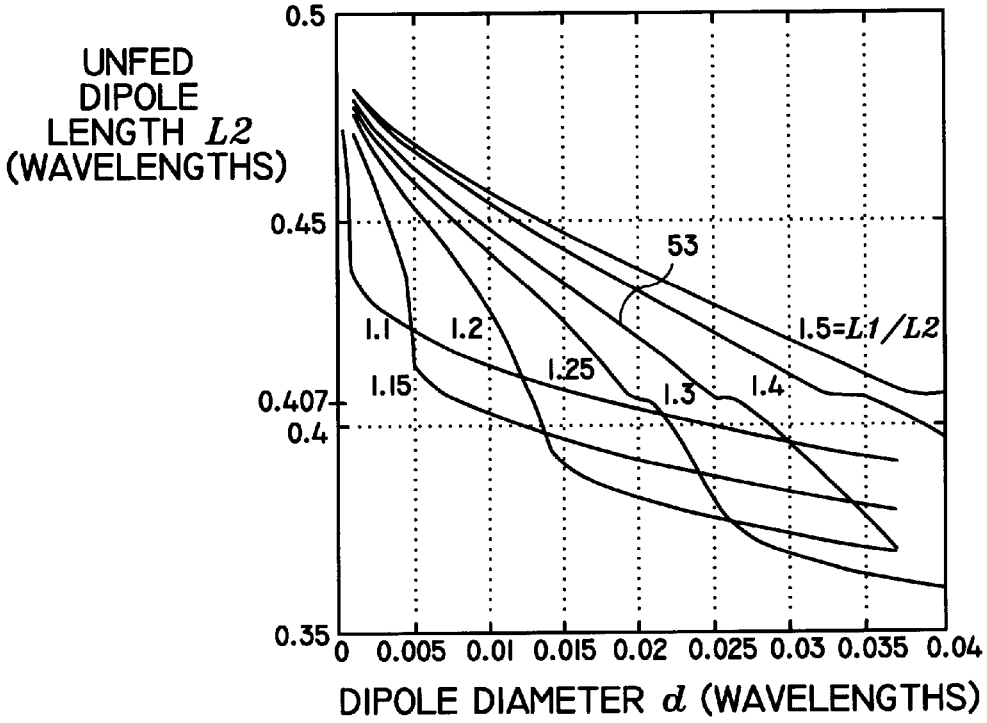
FIG. 4 is a graph showing dipole length L2 as a function of dipole diameter for different length ratios.

Turning now to FIG. 4, a graph of unfed dipole length L2 as a function of dipole diameter d is shown for varying length ratios L1/L2. These curves correspond to the wire antenna 10 of FIG. 1, and can be used as design curves to compute gain and front-to-back ratio as will become apparent from the additional graphs in FIGS. 5–7 below. All curves in FIGS. 4–7 were derived from a combination of theoretical and empirical observations. The curves are for the length ratio L1/L2 varying from 1.1 to 1.5. For example, for a length ratio L1/L2 of 1.3, i.e., curve 53, if a length ratio of 1.3 is selected in conjunction with an unfed dipole length L2 of about 0.407 λc, the corresponding dipole diameter is about 0.02 λc, where λc is the wavelength in which the antenna impedance is 50 ohms (minimum VSWR). This diameter would then be a reference diameter used in the design curves described below.

Figure 5:
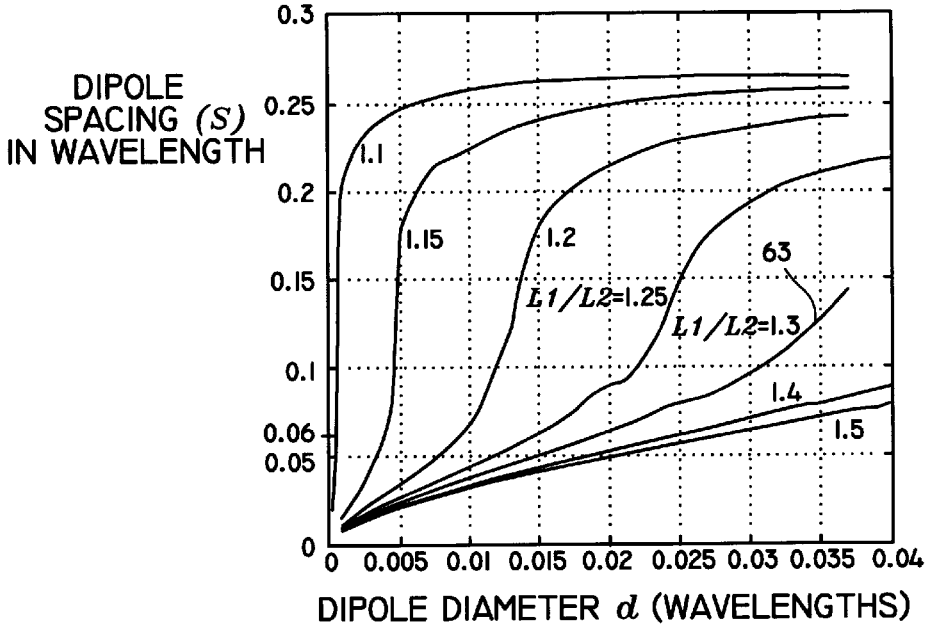
FIG. 5 is graph showing dipole spacing as a function of dipole diameter for different length ratios.

FIG. 5 illustrates a graph of design curves for dipole spacing S in wavelengths as a function of dipole diameter d for a length ratio varying from 1.1 to 1.5. These design curves also correspond to the antenna 10 of FIG. 1. By way of example, for a length ratio L1/L2 of 1.3, and with d selected as 0.02 λc (corresponding to the length L2 of about 0.407 λc as derived from the curves of FIG. 4) then from curve 63, a reference spacing S of about 0.06 λc is derived.

Figure 6:
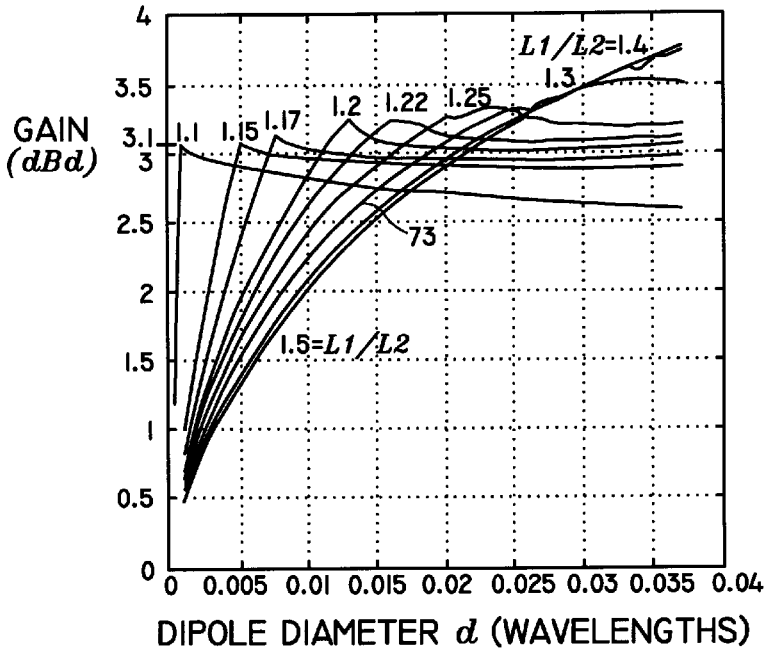
FIG. 6 graphically illustrates antenna gain as a function of dipole diameter for different length ratios.

FIG. 6 shows design curves for gain as a function of dipole diameter d and length ratio ranging from 1.1 to 1.5. For these curves, the dipole diameter d corresponds to the length L2 as derived from FIG. 4 and the spacing S as derived from FIG. 5. For instance, for a length ratio of 1.3 and dipole diameter d of 0.02 λc as in the example above, a gain of about 3.1 dBd would be derived from curve 73. This gain would result if a spacing S of about 0.06 λc and a length L2 of about 0.407 λc were used, as derived above. Working backwards from FIG. 6, if a higher gain were desired, e.g., 3.4 dBd, then d would be chosen at 0.029 λc for the same length ratio of 1.3. Then, S would be derived from FIG. 5 as 0.09 λc, and L2 derived from FIG.4 as 0.398 λc. Accordingly, from FIGS. 4–6, one can readily select antenna dimensions for a target gain and minimum VSWR at any desired frequency.

Figure 7:
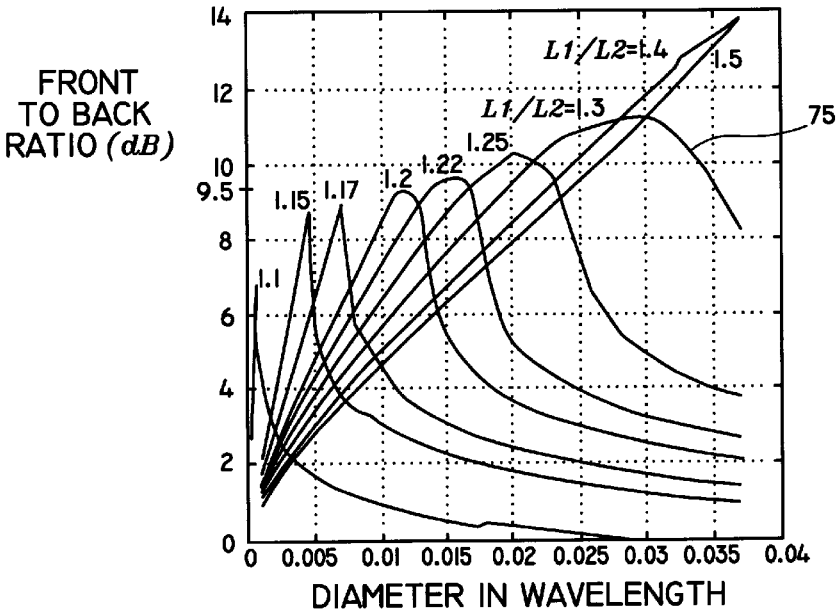
FIG. 7 is graph of the antenna front to back ratio as a function of dipole diameter for different length ratios.
Figure 8:
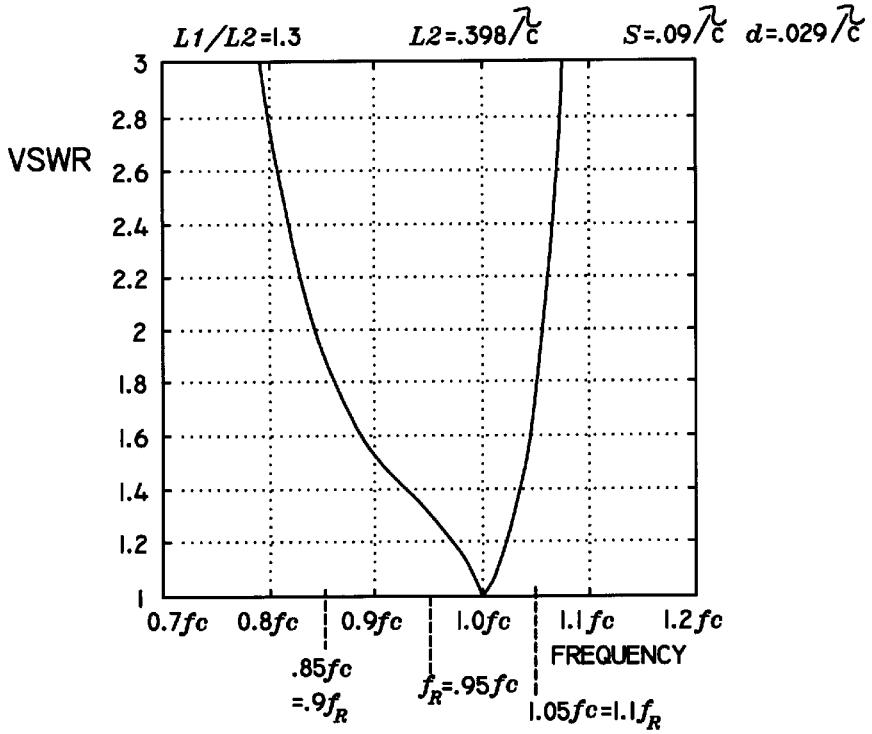
FIG. 8 shows antenna VSWR as a function of frequency for a particular embodiment of the present invention.

FIG. 7 is a graph showing design curves for front-to-back ratio (FBR) as a function of dipole diameter d. For the example discussed above, with a length ratio of 1.3 and d of 0.02 λc, an FBR of 9.5 dB is derived from curve 75. For the same length ratio of 1.3, if a higher FBR is desired, e.g., 11 dB, d would be selected at 0.029 λc, in correspondence with S of 0.09 λc and L2 of 0.398 λc derived from FIGS. 4–5. For this exemplary case, VSWR is plotted in FIG. 8 as a function of frequency, normalized to frequency $f_C$ corresponding to λc. Over a frequency band of about 0.85 $f_C$ to 1.05 $f_C$, i.e., greater than a 20% band, VSWR of antenna 10 in a 50 ohm system is better than 2:1 (computed). Measured results show close correlation to the computed results. When accounting for manufacturing tolerances, VSWR is typically better than 2:1 over about a 10% bandwidth (at least) for the above design parameters. It is noted that for this example, the VSWR characteristics are asymmetrical as a function of frequency with respect to the minimum VSWR frequency $f_C$, when considering bandwidths greater than a few percent. Hence, another reference frequency such as $f_R$ would be the band center for wider bands. In FIG. 8, over an approximate 20% operating band from 0.9 $f_R$ to 1.1 $f_R$, VSWR is symmetric about $f_R$=0.95 $f_C$.

Figure 9:
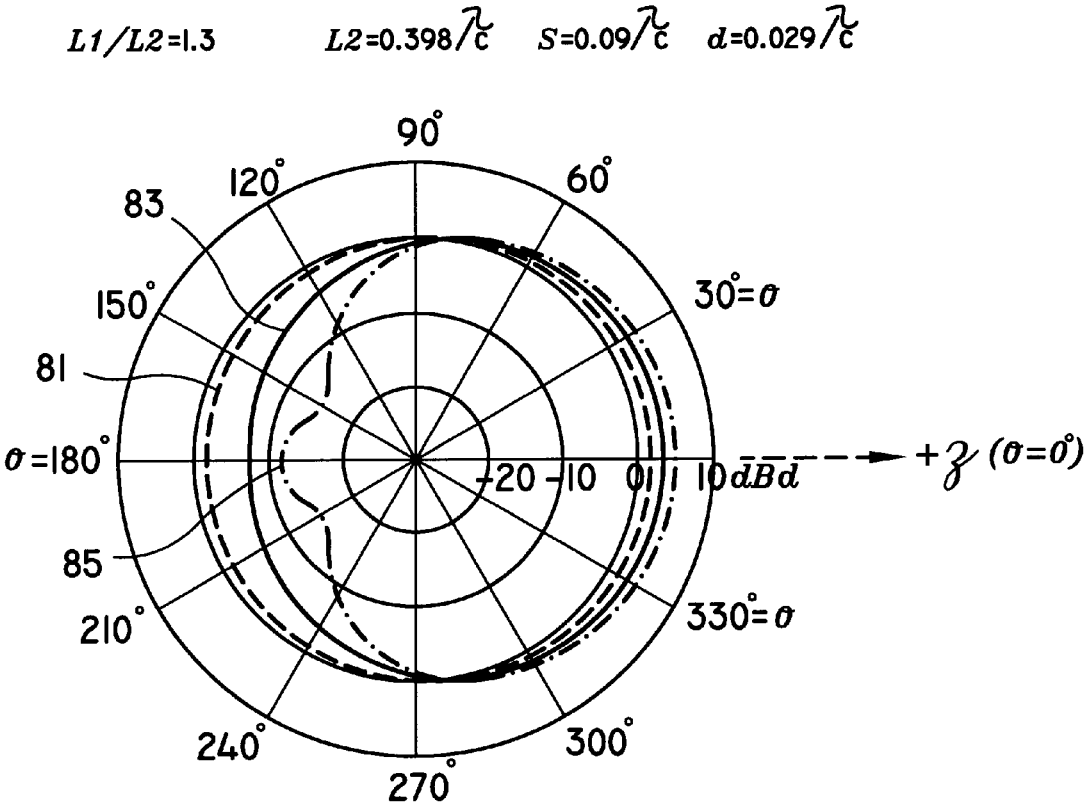
FIG. 9 shows radiation pattern over an operating frequency band for a particular embodiment of the invention.

Referring now to FIG. 9, a radiation pattern is plotted as a function of the angle θ oriented as shown in FIG. 1A, i.e., in the plane of the magnetic field (H plane). The pattern is plotted for wire antenna 10 of FIG. 1A with the exemplary parameters L1/L2=1.3, L2=0.398 λc, S=0.09 λc and d=0.029 λc, as discussed above, for three different frequencies: 0.85 $f_C$ (curve 81), 1.0 $f_C$ (curve 83) and 1.05 $f_C$ (curve 85). Gain ranges from about 1.3 dBd to about 4.7 dBd over the band. FBR ranges from about 3 dB to about 17.8 dB over the band. When accounting for manufacturing tolerances, these results would typically occur over at least about a 10% bandwidth.

For devices that can operate over a narrower bandwidth, a higher gain and higher front-to-back ratio can be realized over the narrower band. For example, with the antenna parameters of the example of FIGS. 8–9, gain of at least 3 dBd and an FBR of more than 10 dB can be obtained over a 6% bandwidth ranging from about 099 $f_C$ to 1.05 $f_C$ with VSWR in a 50 ohm system still better than 2:1 over the band as seen in FIG. 8. For a manufactured antenna, these results are attainable over at least about a 4% bandwidth when considering typical manufacturing tolerances.

For the printed circuit board embodiments of FIGS. 2–3, similar design curves can be generated based on empirical data as a function of conductor width W, conductor height h, dielectric constant and thickness of the substrate, spacing S, unfed dipole length L2 and length ratio L1/L2. In essence, superior results over conventional Yagi antennas are achievable by selecting the length ratio L1/L2 as greater than 1.1, preferably in the range of 1.1 to 1.5 and, most preferably, about 1.3, with L2 less than about 0.45 λc and with appropriate selection of the other parameters. For example, the special case of L1/L2=1.3 with L2 in the range of 0.39–0.42 λc and S in the range of 0.07–0.11 λc, with appropriate selection of W, h and the PCB substrate, will yield substantially similar results in terms of VSWR, gain and FBR as presented above for the wire antenna 10.

The antennas disclosed herein are particularly useful at UHF and microwave frequencies, where the antenna size becomes suitable for small personal communication devices. Examples include the 2.4 and 5.8 GHz ISM bands.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A directional dipole array antenna, comprising:

a driven dipole of length L1 for radiating at a frequency $f_C$; and an unfed dipole of length L2 disposed substantially parallel to the driven dipole, and closely spaced therefrom to be excited by near field coupling from the driven dipole, wherein the ratio L1/L2 is at least 1.1, and a beam is radiated from said driven dipole and said unfed dipole directionally at said frequency $f_C$.

2. The antenna of claim 1, wherein only said driven and unfed dipoles are included in said array.

3. The antenna of claim 1, wherein the ratio L1/L2 is in the range of 1.1 to 1.5.

4. The antenna of claim 1, wherein at said frequency $f_C$ within an operating frequency band of the antenna, L2 is less than 0.45 wavelengths.

5. The antenna of claim 4, wherein said frequency $f_C$ is a frequency in which the antenna is substantially matched to a 50 ohm transmission line feed.

6. The antenna of claim 4, wherein said antenna is connected directly to a 50 ohm transmission line feed, said operating frequency band extends from about 0.85 $f_C$ to about 1.05 $f_C$ and said antenna producing a voltage standing wave ratio (VSWR) of less than about 2:1 in a 50 ohm system over said operating frequency band.

7. The antenna of claim 1, wherein the ratio L1/L2 is about 1.3.

8. The antenna of claim 7, wherein L2 is in the range of 0.39–0.42 wavelengths at said frequency $f_C$ at which the antenna is substantially matched to a 50 ohm transmission line feed, and the unfed element is spaced from the driven element by a spacing in the range of 0.07 to 0.11 wavelengths at frequency $f_C$.

9. The antenna of claim 1, wherein said dipoles are wires.

10. The antenna of claim 9, wherein said driven dipole is connected directly to a 50 ohm twin-line feed.

11. The antenna of claim 1, wherein said dipoles are printed circuits on a single sided printed circuit board, and said driven dipole being connected directly to a coplanar stripline transmission line feed.

12. The antenna of claim 11, wherein said coplanar stripline has a characteristic impedance of 50 ohms.

13. The antenna of claim 1, wherein said dipoles are printed circuits on a double sided printed circuit board, two radiating halves of said driven element being separated from one another by a dielectric layer of said circuit board, and said driven dipole being connected directly to a broadside coupled stripline feed.

14. The antenna of claim 13, wherein said broadside coupled stripline has a characteristic impedance of 50 ohms.

15. A directional dipole array antenna, comprising:

a driven dipole of length L1 driven by a 50 ohm transmission line feed for radiating at a frequency $f_C$; and an unfed dipole of length L2 substantially parallel to the driven dipole, and closely spaced therefrom to be excited by near field coupling from the driven dipole, wherein only said driven and unfed dipoles are included in said array antenna, a length ratio L1/L2 is at least 1.1, L2 is less than 0.45 wavelengths at a frequency $f_C$ within an operating frequency band of the antenna and said dipole lengths being selected in conjunction with spacing between said dipoles such that said antenna is substantially matched to said 50 ohm transmission line feed over the operating band and radiates a directional beam at said frequency $f_C$.

16. The antenna of claim 15, wherein said operating frequency band is in the microwave frequency range.

17. The antenna of claim 15, wherein the ratio L1/L2 is in the range of 1.1 to 1.5, and said antenna exhibits a voltage standing wave ratio (VSWR) of less than about 2:1 over a frequency range extending from about 0.85 $f_C$ to about 1.05 $f_C$.

18. A dipole array antenna, comprising:

a driven dipole of length L1 driven by a 50 ohm transmission line feed; and an unfed dipole of length L2 substantially parallel to the driven dipole, and closely spaced therefrom to be excited by near field coupling from the driven dipole;

wherein only said driven and unfed dipoles are included in said array antenna, the ratio L1/L2 is about 1.3, L2 is selected in the range of 0.39–0.42 wavelengths at a frequency $f_C$ in which the antenna is substantially matched to the 50 ohm transmission line feed, and a spacing S between said driven and unfed dipoles is selected in the range of 0.07 to 0.11 wavelengths at frequency $f_C$ wherein L2 and S are selected in conjunction with a dipole dimension transverse to the dipole length such that over about a six percent bandwidth VSWR is less than 2:1, antenna gain is greater than 3 dB with respect to a half wave dipole and front-to-back ratio is greater than 10 dB.

19. The antenna of claim 18, wherein said frequency $f_C$ is in the microwave frequency range.

20. The directional dipole antenna according to claim 1, wherein said beam has a maximum radiation in the direction +Z corresponding to an angle $\theta=0$.

* * * * *